US007223574B2

(12) United States Patent
Lei et al.

(10) Patent No.: US 7,223,574 B2
(45) Date of Patent: May 29, 2007

(54) PORTABLE MEMORY DEVICE WITH PROTECTIVE CAP

(75) Inventors: Mao-Lin Lei, Kunshan (CN); Jia-Yong He, Kunshan (CN); Qi-Jun Zhao, Kunshan (CN); Yu-Long Mao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/404,399

(22) Filed: Apr. 14, 2006

(65) Prior Publication Data

US 2006/0234533 A1 Oct. 19, 2006

(30) Foreign Application Priority Data

Apr. 14, 2005 (CN) ..... 2005 2 0070822

(51) Int. Cl.
*H01R 13/44* (2006.01)

(52) U.S. Cl. ..... 435/135; 439/140

(58) Field of Classification Search ..... 439/135, 439/136, 140, 141, 350, 352, 367
See application file for complete search history.

(56) References Cited

U.S. PATENT DOCUMENTS 4,961,711 A * 10/1990 Fujiura et al. ..... 439/357
6,056,578 A 5/2000 Lin
6,612,853 B2 9/2003 Wu
6,650,534 B2 * 11/2003 Tree ..... 361/686
6,743,030 B2 6/2004 Lin et al.
6,799,986 B2 10/2004 Igarashi et al.
6,808,400 B2 10/2004 Tu
6,926,544 B2 8/2005 Lee
6,932,629 B2 8/2005 Ikenoue
6,999,322 B1 * 2/2006 Lin ..... 361/752
7,014,490 B1 3/2006 Morikawa
2002/0147698 A1 * 10/2002 Tree ..... 707/1
2004/0233645 A1 * 11/2004 Chen ..... 361/737

* cited by examiner

*Primary Examiner*—James Harvey
*Assistant Examiner*—Travis Chambers
(74) *Attorney, Agent, or Firm*—Wei Te Chung

(57) ABSTRACT

A portable storage device (1) includes a memory device with a USB mating port (20) and a protective cap (30) detachably mated with the USB mating port in a mating direction. The USB mating port has an engagement portion (211). The protective cap includes a case (31) for receiving the USB mating port and a latching member (32) on the case. The latching defines a retaining portion (324) thereon to engage with the engagement portion (211) of the USB mating port. The latching member is movable between a disengaged position and an engaged position in the mating direction to thereby engage/disengage the mating port with/from the cap.

19 Claims, 9 Drawing Sheets

PORTABLE MEMORY DEVICE WITH PROTECTIVE CAP

BACKGROUND OF THE INVENTION

1. Field of the Invention

The present invention generally relates to a portable memory device, and particularly to a portable memory device with a protective cap which can provide the memory device a good protection.

2. Description of Related Art

Please refer to FIG 9, which is a schematic diagram of a conventional portable memory device. The portable memory device includes a case 15, a universal serial bus (USB) interface 13, and a cover 11 detachably connected to the case 15 to cover the USB interface 14.

The case 15 of the above-described conventional portable memory device is internally provided with circuits for storing and transmitting computer data, and is electrically connected to the USB interface 13, such that when the cover 11 is removed from the case 15 to expose the USB interface 13, the USB interface 13 may be directly plugged into a USB connector provided on a computer to function like an externally connected hard disk drive to transmit or store data. When the USB interface 13 is unplugged, the portable memory device can be carried by a user to any other place or be connected to another computer. Therefore, the portable memory device is highly mobile and convenient for use.

The USB interface 13 of the above-described conventional portable memory device is connected to an end of the case 15, and is protected by the cover 11 against uselessness resulted from collision, damage, distortion or deformation of the USB interface 13. During usage, the cover 11 may be taken off from the case 15 and easily lost. Once the cover 11 is lost, the USB interface 13 is no longer suitably protected and tends to become damaged, failed, and unusable.

Hence, how to improve the disadvantage in prior art is the major discussion of the present invention.

BRIEF SUMMARY OF THE INVENTION

Accordingly, it is an object of the present invention to provide a portable memory device with a protective cap to protect a USB port thereof.

In order to achieve the above-mentioned object, a portable memory device with a protective cap firmly mated with a USB mating port is provided. The portable memory device comprises a memory unit with the USB mating port, a protective cap detachably mated with the USB mating port in a mating direction. The USB mating port comprises an outer metallic shell with an engagement portion defined therein. The cap comprises a case and a latching member in the case. The latching member defines a retaining portion thereon to engage with the engagement portion. The latching member is movable between a disengaged position and an engaged position in the mating direction to thereby engage/disengage the USB mating port with/from the protective cap. The retaining portion is brought into engagement with the engagement portion by inserting the USB mating port into the cap. Moreover, by detaching the USB mating port from the cap, the latching member moves to the disengaging portion where the engagement of the retaining portion with the engagement portion is released. Therefore, the USB mating port and the cap can be easily and firmly engaged with each other, and also this engagement can be easily released.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
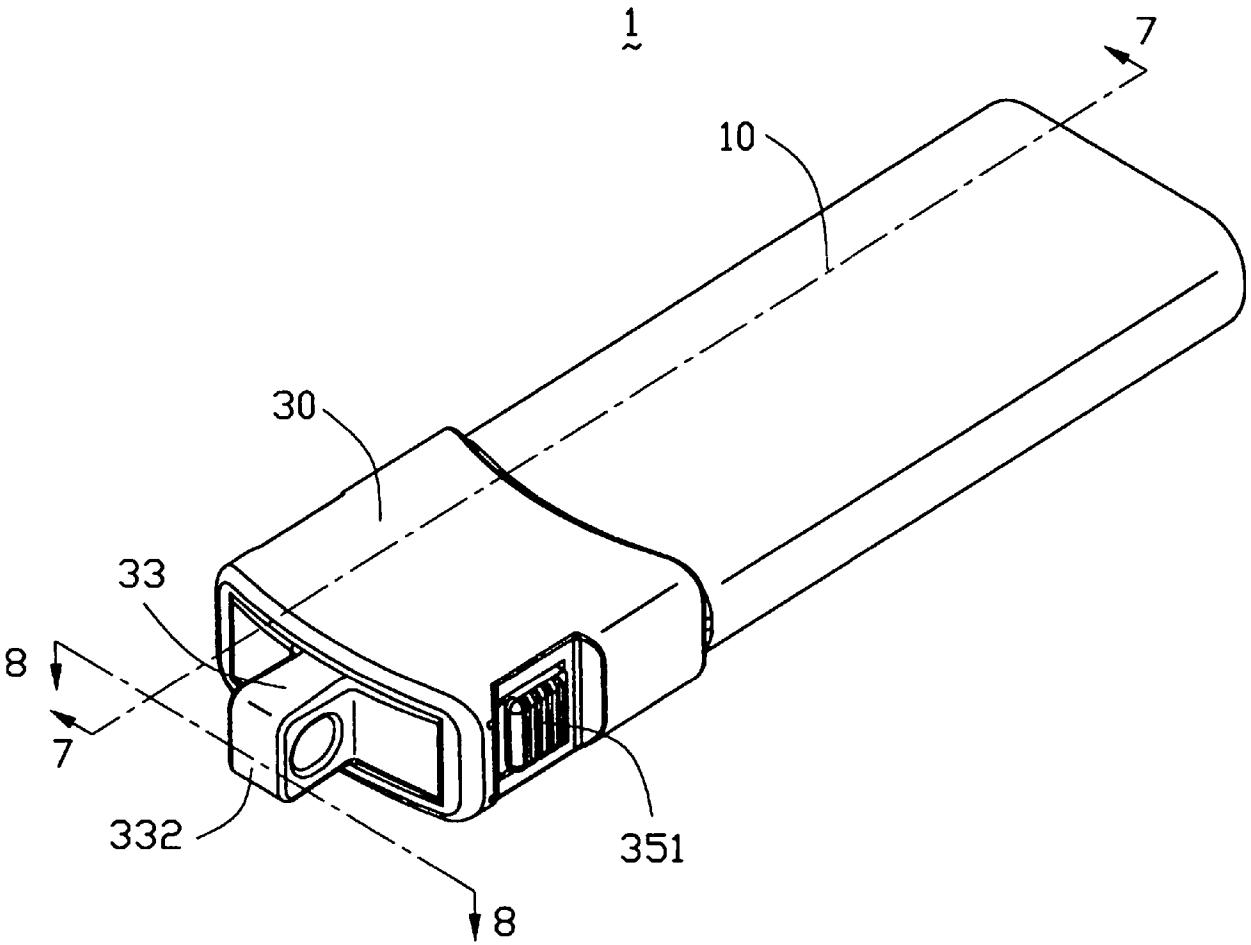
FIG. 1 is a perspective schematic assembly view of a portable memory device with a protective cap in accordance with the preferred embodiment of the present invention.

Reference will now be made to the drawing figures to describe the present invention in detail.

With reference to FIGS. 1–4, a portable memory device 1 in accordance with the present invention comprises a cartridge member 10, a printed circuit board with a memory unit (not shown) received in the cartridge member 10, a USB mating port 20 electrically connecting with the printed circuit board, and a protective cap 30 detachably mated with the USB connector 20.

The cartridge member 10 extending in a longitudinal direction. One end of cartridge member 10 is provided with the USB mating port 20. The USB mating port 20 may has a conventional structure, which includes a substantial rectangular tubular metal shell 21, a mating set 22 received in the shell 21 and a plurality of contacts 40 arranged on the mating set 22 electrically connecting with the printed circuit board. The metal shell 21 defines a top wall 210 and a bottom wall 212. Two pairs of through holes 211 are defined in the top wall 210 and bottom wall 212 symmetrically severing as an engagement portion engaging with the cap.

Figure 4:
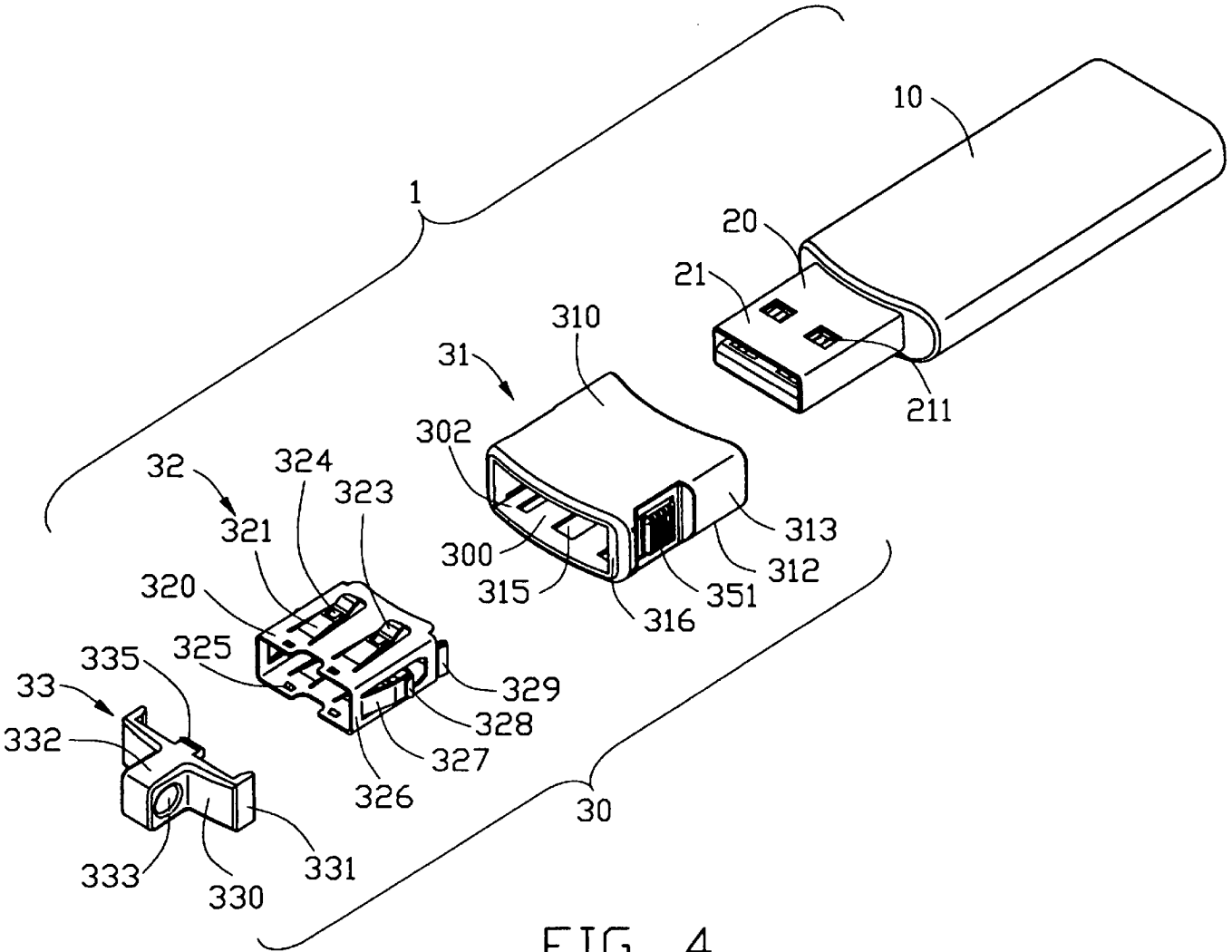
FIG. 4 is an exploded perspective view of the protective cap shown in FIG. 1, showing the USB mating port detached from the protective cap.
Figure 5:
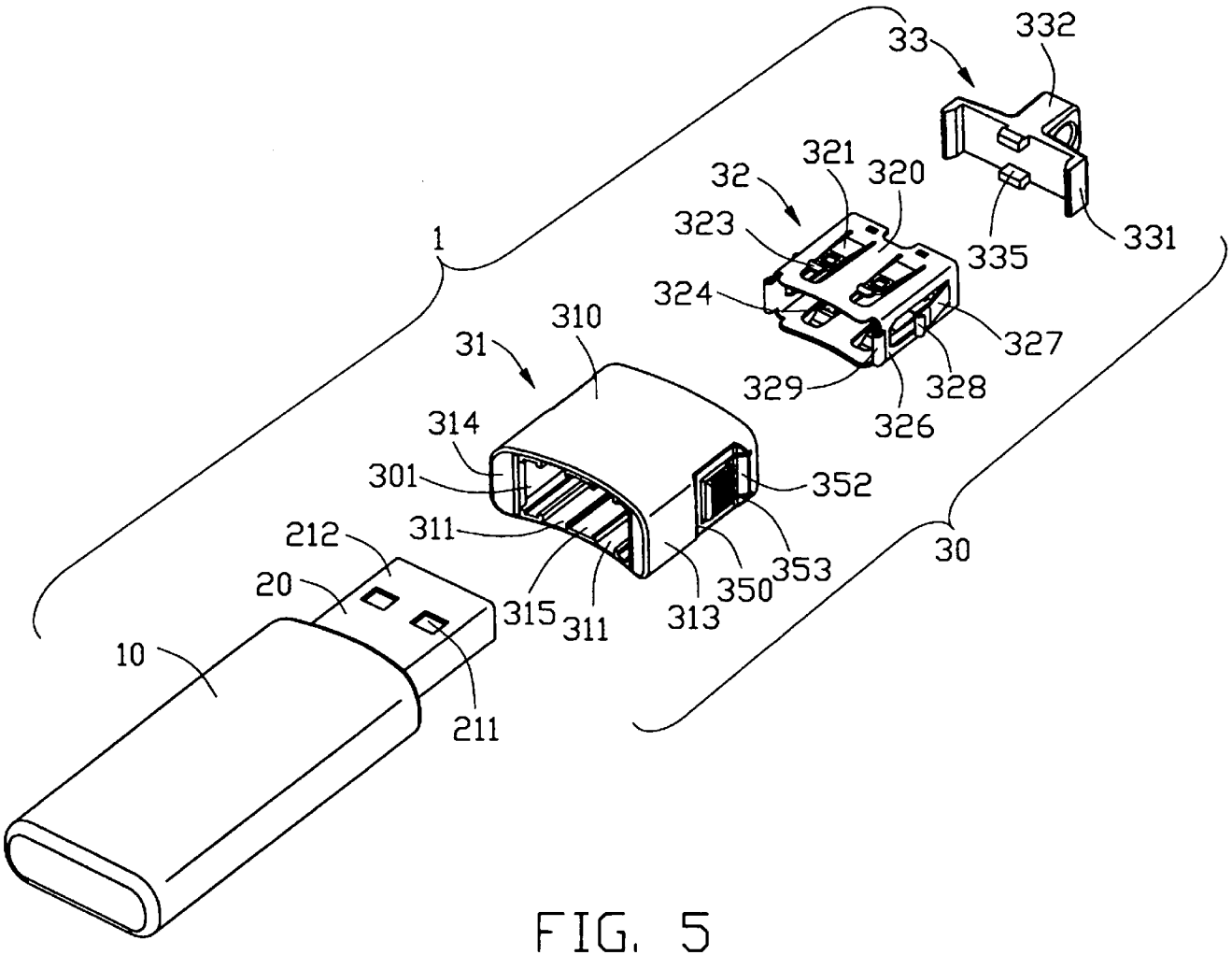
FIG. 5 is a view similar to FIG. 4, while taken from another aspect.
Figure 6:
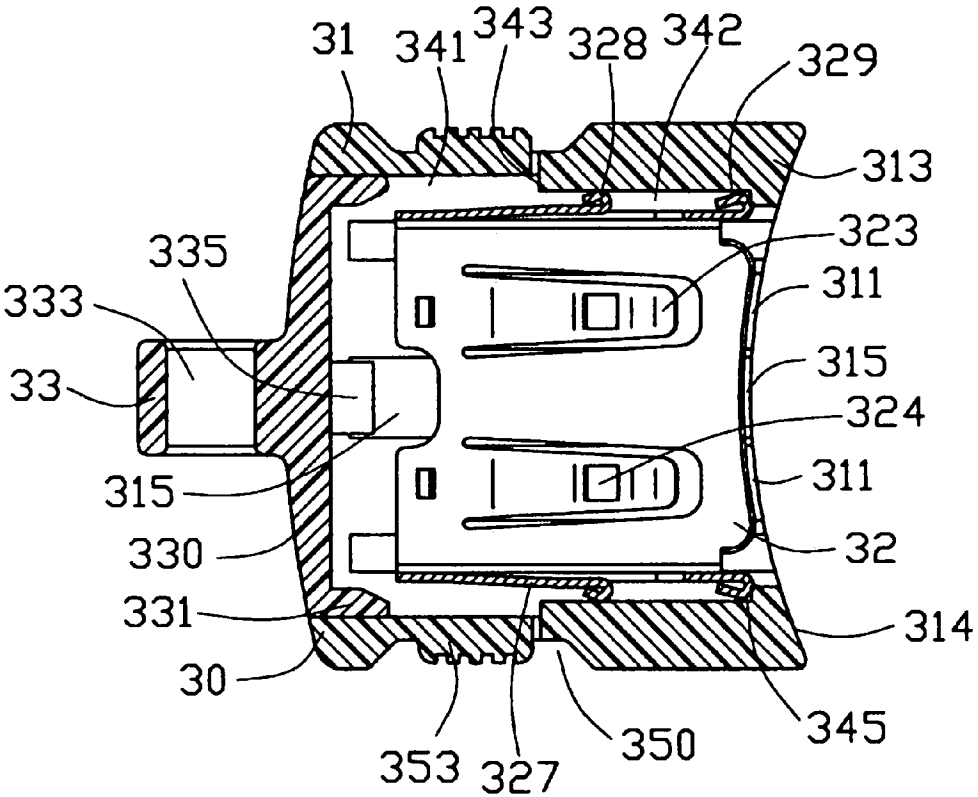
FIG. 6 is a partially enlarged sectional view of the protective cap taken along line 6—6 of FIG. 2, showing a position of a shell of the cap relative to the case of the cap when the USB mating port is detached from the protective cap.
Figure 7:
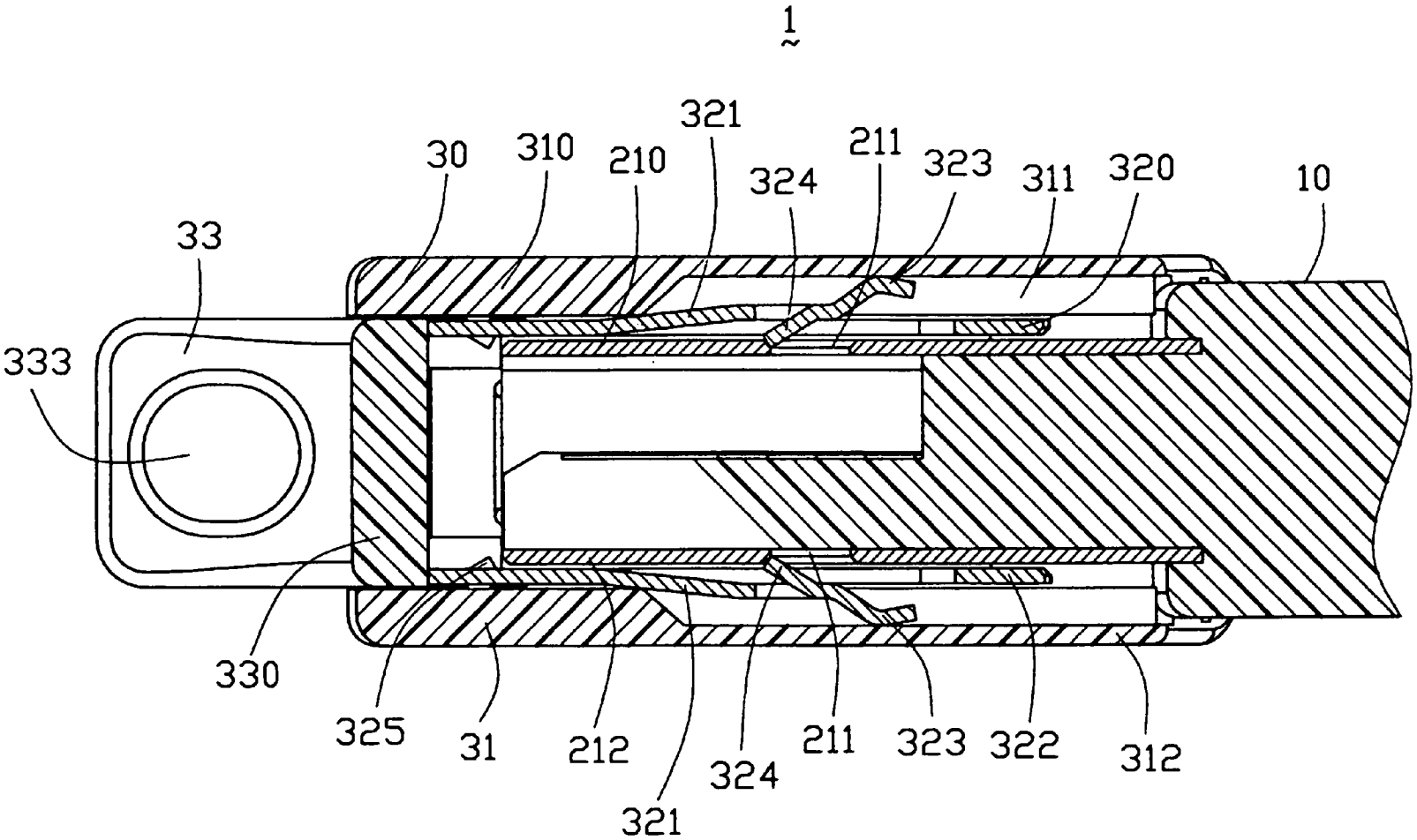
FIG. 7 is a partially enlarged sectional view taken along line 7—7 of FIG. 1, showing a condition in which a retaining portion of the protective cap engages with an engagement portion of the USB mating port.

Referring to FIGS. 4 and 5 in conjunction with FIGS. 6 and 7, the protective cap 30 includes a case 31, a chamber 300 enclosed by the case 31, a movable metallic shell 32 received in the chamber 316 and an protruded rear portion 33 engaged with the case 31 at a rear end 316 thereof. The case 31 is formed by injection molding of an insulative resin such as propylene, including a top wall 310, a bottom wall 312, a pair of opposite sidewalls 313 and a front mating end 314 with a mating opening 301 defined therein. The mating end 314 is opposite to the rear end 316 and faces to the USB mating port 20. The rear end 316 is defined a rear opening 302, therethrough receiving the protruded rear portion 33. The protruded rear portion 33 includes a main body 330, a pair of mounting portions 331 extending forwardly from two free ends of the main body 330 to engage with inner faces of the sidewalls 313 of the case 31, a pair of locking portions 335 protruding forwardly from a central portion of upper and lower edges of the main body 330, and a projection portion 332 extending rearwardly from the central portion of the main body 330. The main body 330, the pair of mounting portions 331 and the pair of locking portions 335 are all received in the case 31 through the rear opening 302. The projection portion 332 is outside the case 31 with a through hole 333 defined therein for a string or a key ring passing through and tied, to facilitate user's carrying of the memory device 1.

Referring to FIGS. 6 and 7, inner surfaces of the top wall 310, bottom wall 312 and sidewalls 313 of the case 31 are defined with a plurality of recessed passageways, named first passageways 311 defined in the top and bottom walls, second passageways 342 defined in the sidewall 313 and locking passageways 315 defined in the top and bottom walls 310, 312. The first passageways 311 are in an arrangement that a pair of them is defined in the top wall 310 and another pair of them is defined in the bottom wall 312, symmetrically. The second passageways 342 are in an arrangement that a pair of them is defined in the pair of sidewalls 313 respectively. The locking passageways 315 are a pair and each of them is between a pair of first passageways 311. Besides, a pair of recesses 341 is defined in the inner surfaces of the pair of sidewalls 313, respectively. The pair of recesses 341 is located behind the pair of second passageways 342 and they are in communication with each other in the longitudinal/mating direction. The recesses 341 are recessed into the sidewalls deeper than that referring to the second passageways 342. The first passageways 311, the second passageways 342, the recesses 341 and the locking passageways 315 all extend in the mating direction. The recessed first passageways 311 and locking passageways 315 extend from the mating end 314 toward the rear end 316 and terminate near the rear end 316, as clearly shown in FIGS. 6 and 7. The second passageways 342 extend from a position near the mating end 314, but not the mating end 314, toward the rear end 316 and terminate near a middle portion of the case 30 in the mating direction direction, as clearly shown in FIG. 6. The recesses 341 extend rearwardly from a position where the second passageways terminate and terminate at the rear end 316 of the case 31, as clearly shown in FIG. 6, too.

Both the recesses 341 and the second passageways 342 are defined with stopper portions 343, 345 at a front end thereof. Regarding the seconding passageways 342, the stopper portions 345 thereof are formed as a step between the recessed passageways 342 and the case 31. Similarly, as a result of that depth of the recessed recesses 341 is deeper than that of the second passageways 342, the stopper portion 343 are formed between the second passageways 342 and the recesses 341 in a manner of step. As seen in FIG. 6, the stopper portions 345 are front ones, and the stopper portions 343 are rear ones. So, we name the stopper portion 345 as front stopper portion 345 and the stopper portions 343 as rear stopper portion 343.

And besides, an disengaging member is provided on the sidewalls 313 and disposed near the rear end 316, in this preferred embodiment, which is a pair of buttons 351 integrally molded with the case 31. Each of the pair of buttons 351 includes a connecting portion 352 connecting with the sidewall 313 and an operation portion 353 formed at a free end thereof. The connecting portion 352 is inclined inwardly. The operation portion 353 is in a notch 350 defined in the sidewalls, thereby being spaced from the case 31 and touchable to be pressed inwardly into the recess 341.

Now, a detailed description will be made to the movable metallic shell 32 received in the case 31. The metallic shell 32 is formed by pressing an electrically-conductive thin sheet (made of copper, a copper alloy, an aluminum alloy or the like) into a generally rectangular tubular shape. With regard to FIGS. 4–7, the metallic shell 32 comprises a top wall 320, a bottom wall 322 and a pair of opposite sidewalls 326 connecting the top and bottom walls 320, 322. Each of the top and bottom walls 320, 322 defines a pair of inclined first spring arms 321, according to the first passageways 311, extending therefrom forwardly and outwardly at an acute angle to the walls 320, 322. Each of the pair of sidewalls 326 defines a second slanting spring arm 327, according to the second passageway 342, extending therefrom forwardly and outwardly at an acute angle to the sidewalls 326. The first spring arms 321 and the second spring arms 327 all are cantilever-like, as a result of forming a generally U-shaped groove through the walls by stamping such that these spring arms are connected to the walls (top wall 320, bottom wall 322 and sidewalls 326) at its rear end in the USB mating port mating direction.

The spring arms 321 each have a slanting claw portion 324 stamped therefrom and projecting rearwardly and inwardly, as clearly shown in FIG. 7. Distal ends 323 of the spring arms 321 are smooth and slideable along the first passageways 311 with the movable metallic shell 321. The second spring arms 327 each include a pressed portion 328 formed at distal ends thereof in a manner of being bent outwardly and rearwardly. Same to the distal ends 323 of the spring arms 321, the pressed portions 328 are smooth and slideable along the second passageways 311 with the whole shell 32. The second spring arms 327 can be pressed inwardly via the button 351 to press the pressed portions 328 thereof.

Two pairs of tabs 325 are stamped into interior of the shell 32 from the top and bottom walls 320, 322, respectively. The two pairs of tabs 325 are disposed behind the two pairs of spring arms 321 and near a rear end of the shell 32 to engage with a distal end of the USB mating port 20 (described later). Besides, a pair of protrusions 329 extends forwardly from front end of the sidewalls 326 and then bent outwardly and rearwardly, as clearly shown in FIG. 6. The pair of protrusions 329 is smooth and slideable along the second passageways 311 with the movable metallic shell 32.

Turning to FIG. 4–8, in assembly, the shell 32 is inserted into the case 31 through the rear opening 302 with the first and second spring arms 321, 327 respectively received and sliding in the first passageways 311 and the recesses 341. The front stopper portions 345 can prevent a further inserting of the shell 32 into the case 31. Then the rear portion 33 is also inserted into the case 31 through the rear opening 302 in a fixed manner, to seal the opening 302 and prevent the shell's rearward movement in case of moving out the case 31. The pair of mounting portions 331 enters the recesses 341 and the locking portions 335 engages with the pair of locking passageways 315 in the top and bottom walls 310, 312 of the case 31. The distal end of the locking portion 315 is in a manner of hook, thus the locking portions 335 are engaged with the locking passageways 315 firmly and ensure the shell 32 secured in the case 31. The main body 330 is in the case 31 and is just matched with and seals the opening 302. The projection portion 332 with the through hole 333 is outside the case 31 for facilitating user's carrying of the memory device 1.

Figure 2:
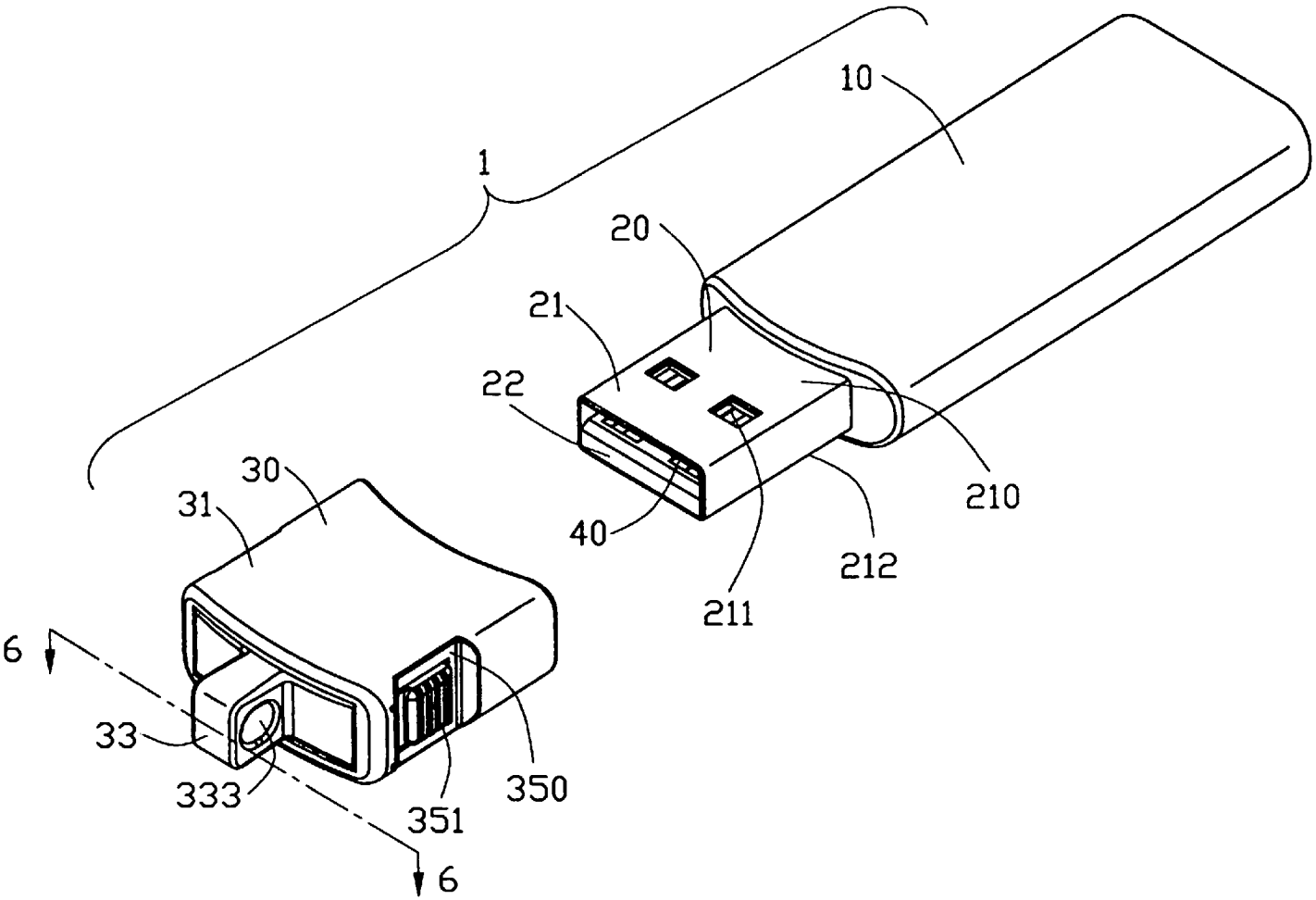
FIG. 2 a partially exploded perspective schematic view of FIG. 1, showing a USB mating port of the portable memory device detached from the protective cap.
Figure 3:
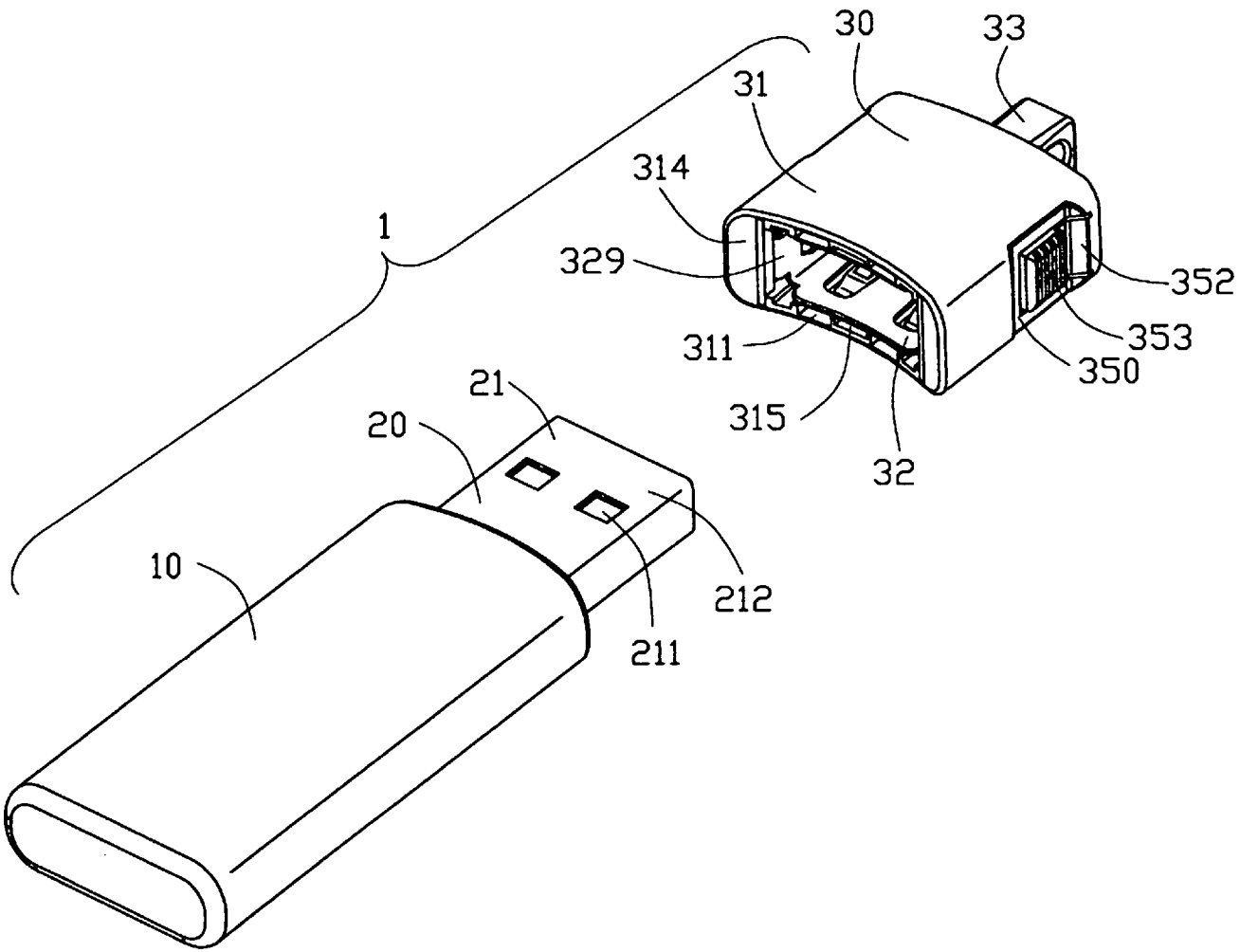
FIG. 3 is a view similar to FIG. 2, while taken from another aspect.
Figure 8:
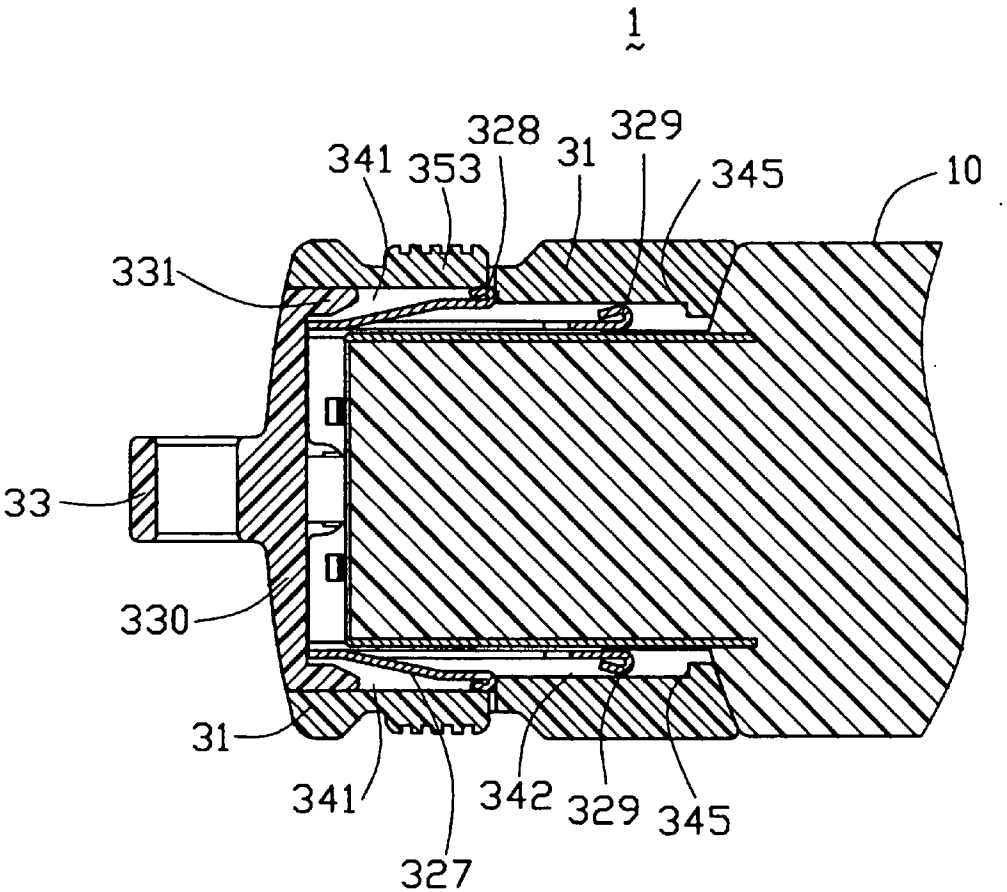
FIG. 8 is another partially enlarged sectional view taken along line 8—8 of FIG. 1, showing a position relationship between the shell and the case when the USB mating port engages with the protective cap.
Figure 9:
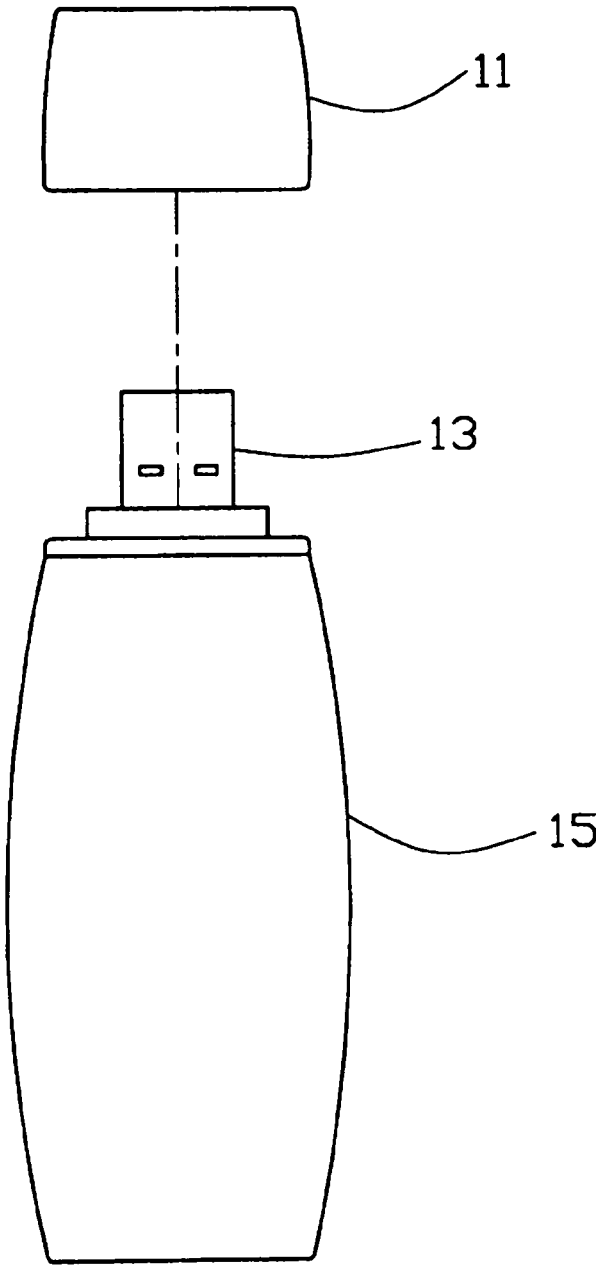
FIG. 9 (PRIOR ART)
FIG. 9 is a schematic diagram of a conventional portable memory device.

Referring to FIGS. 1–3 in conjunction with FIGS. 7–8, in use, the protective cap 30 is to receive and protect the USB mating port 20. When being fitted into the cap 30 in the mating direction, first, the USB mating port 20 is fully accommodated in the tubular shell 32, abutting against the tabs 325 of the metallic shell 32 of the cap 30 and the through holes 211 thereof confronting the claw portions 324 of the metallic shell 32 but free from each other. When the USB mating port 20 is further inserted, the metallic shell 32 is urged to move inwardly via the USB mating port 20 abutting against the tabs 325, and meanwhile the spring arms 321, the second spring arms 327 and the protrusions 329 all slide in their according passageways (the spring arms 321 in the first passageways 311, the second spring arms 327 and the protrusions 329 in the second passageways 342). Further inserting of the USB port 20, portions of the spring arms 321 behind the claw portions 324 slide outside their according passageways 311 and are resiliently deformed toward the USB mating port 20 as they are pressed by the inner walls of the case 30, bringing the claw portions 324 into moving toward the through holes 211 of the USB mating port 20. Eventually, the shell 32 arrives at an engaged position where the slant claw portions 324 enter the through holes 211 as a result of the inwardly resilient deformation of the spring arm 321, as clear shown in FIG. 7, in a manner of a rear edge of the holes 211 being hold against the distal ends of the claw portions 324 to obstruct an outward movement of the USB mating port 20. In this position, the metallic shell 32 is secured in the case 30 failing to slide in the case 31 (described below). Consequently, the USB mating port 20 is secured in the cap 30.

When the USB mating port 20 and the metal shell 32 of the cap 30 are in the engaged position as shown in FIGS. 7 and 8, the main body 330 of the rear portion 33 can prevent a rearward movement of the metallic shell 32 resulted from a careless further inserting of the USB mating port 20. The mating end 314 of the case 31 also prevents the further inserting of USB post via abutting against a front end of the chamber 10. The second spring members are in the recesses 341 with the projected pressed portions 328 being obstructed by the rear stopper portions 343 (labeled in FIG. 6). So the metal shell 32 is secured in the case 31 and engages with the USB mating port 20. The movable metallic shell 32 cannot move forwordly unless the pressed portions 328 are pressed inwardly and out the recesses 341. Clearly seen in the FIG. 8, the pressed portions 328 are near the operation portions 353 of the buttons 351 and can be pressed inwardly by the operation portions 353.

Obviously, the USB mating port 20 is latched in the cap 30 via engagement of claw portions of first spring arms 321 of the shell 32 with the holes 211 or the like defined in the metal shell 21 of the USB mating port 20 and the engagement of the second spring arms 327 with the rear stopper portions 343, that is to say, the shell 32 serves as a latching member, the first spring arms 321 with the claw portions 324 serve as a retaining portion, and the holes 211 defined in the metallic shell 21 of the USB mating port 20 serve as an engagement portion engaging with the retaining portion.

When it is desired to detach the USB mating port 20 from the cap 30, users only need to urge the operation portions 353 of the disengaging member inwardly to press the pressed portions 328 to move inwardly and out the recesses 341, and into the first the passageways 342 with the detaching USB mating port 20 via the rear edges of the holes 211 of the USB mating port 20 abutting against the claw portions 324 of the shell 32 as shown in FIG. 7. When further pull the USB mating port 20 in a direction away from the cap 30, the spring arms 321, the second spring arms 327 and the protrusions 329 all slide forwardly along their according passageways (the spring arms 321 in the first passageways 311, the second spring arms 327 and the protrusions 329 in the second passageways 342). Meanwhile, the portions of the spring arms behind the claw portions 324 are resiliently restored toward its original condition. As a result, the claw portions 334 move away the through holes 211. When the USB mating port 20 and the shell 32 arrives at a disengaged position, the spring arms 321 generally return to their original state and the claw portions 324 disengage from the holes 211 of the USB mating port 20. Then, the USB mating port 20 is detached from the cap 30 freely. It is note that the front stopper portions 345 can obstruct a further outward movement of the metallic shell 32 with the detaching USB mating port 20, as clearly shown in FIG. 6, by abutting against the pair of protrusions 329 formed at the front end of the sidewalls 326.

As described above, in the portable memory device with protective cap of the present invention, the latching member with the retaining portion is provided at the cap, and the engagement portion is provided at the USB mating port, and when the USB mating port is inserted into the cap, the retaining portion is engaged with the engagement portion. Therefore, the cap and the USB mating port are engaged with each other without looseness, and even when vibration or an external force acts on the connector, the USB mating port is prevented from being detached from the cap, thus ensuring the USB mating port is protected regardless of the environment in which the connector is used.

Besides, in the above embodiment of the invention, the latching member is the shell accommodated in the cap, the retaining portion is the resilient claw portion formed at the spring arms of the shell in the cap, and the engagement portion is the hole defined in the metallic shell of the USB mating port, with this arrangement, the protective cap and the USB mating port can be positively and easily engaged with and disengaged from each other.

And besides, by inserting the USB mating port into the cap, the latching member moves to the engaged position and the retaining portion engages with the engagement portion, and by urging the disengaging member, the disengaging member presses the pressed portion of the latching member, thereby the latching member is in a condition allowing it moves to the disengaged position with the detaching USB mating port. In other words, the movement of the latching member to engage the retaining portion with the engagement portion accompanies the inserting movement of the USB mating port into the cap, and movement of the latching member so as to release the engagement of the retaining portion with the engagement portion accompanies the detaching the USB mating port from the cap, and therefore the USB mating port can be easily engaged with and detached from the cap.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, a spring member can be optionally provided between the case and the latching member to constantly urge the latching member to be located in an unlocked position if the memory unit is detached from the cap.

We claim:

1. A portable storage device, comprising:

a memory unit with a mating port, the mating port comprising an outer metal shell with an engagement portion defined therein;

a protective cap detachably mated with the mating port in a mating direction, comprising:

a case defining a mating opening at a front end thereof, the mating opening configured to mate with the mating port; and a latching member defined on the case, the latching member defining a retaining portion thereon to engage with the engagement portion of the mating port and being movable with respect to the case between a disengaged position and an engaged position;

during inserting the mating port into the protective cap through the mating opening, the latching member moving with the inserting mating port from the disengaged position toward the engaged position where the retaining portion engages with the engagement portion; and during detaching the mating port from the protective cap through the mating opening, the latching member moving with the detaching mating port from the engaged position toward the disengaged position where the retaining portion disengages from the engagement portion;

wherein the case comprises a stopper portion engaged with the latching member to obstruct the latching member from moving forward when it is in the engaged position.

2. The portable storage device as described in claim 1, wherein the latching member is movable with respect to the case between the disengaged position and the engaged position the mating direction of the mating port.

3. The portable storage device as described in claim 1, wherein the protective cap comprises a disengaging member and the latching member comprises a pressed portion to be pressed by the disengaging member to disengage the engagement of the latching member from the stopper portion.

4. The portable storage device as described in claim 1, wherein the retaining portion defines a claw portion thereon, and wherein the engagement portion has an opening defined in the metal shell of the mating port, the claw portions engaging with the openings.

5. The portable storage device as described in claim 1, wherein the protective cap comprises a protruded rear portion protruding rearwardly from a rear end of the case and defining a through hole therein.

6. The portable storage device as described in claim 1, wherein the ease comprises two recessed areas defined in inner surface thereof, and wherein the latching member comprises a front and a rear stopped portions defined thereon engaging with the two recessed areas, respectively, to prevent a forward movement of the latching member when it is in the disengaged position and the engaged position.

7. The portable storage device as described in claim 1, wherein the protective cap comprises a movable metallic shell received therein to cover the mating port, the movable metallic shell of the cap defines a pair of opposite top and bottom walls and wherein the latching member is defined on the top and bottom walls.

8. The portable storage device as described in claim 7, wherein the movable metallic shell defines a pair of tabs on the top and bottom walls thereof, the tabs being near a rear end of the shell and protruding inwardly to be engaged with the mating port.

9. The portable storage device as described in claim 7, wherein the latching member comprises a pair of spring arms defined on the top and bottom walls of the movable metallic shell, the retaining portion projecting toward interior of the movable metallic shell to engage with engagement portion of the mating port.

10. The portable storage device as described in claim 9, wherein the case defines a pair of recessed passageways defined in opposite inner face thereof to allow the spring arms being movable into passageways.

11. The portable storage device as described in claim 10, wherein the latching member comprises a pair of another spring arms defined on other opposite sidewalls of the movable metallic shell, each of the another spring arms comprising a pressed portion to be pressed inwardly from a position where the latching member could not move with the detaching mating port to another position where the latching member is movable with the detaching mating port.

12. The portable storage device as described in claim 11, wherein the protective cap comprises a pair of button defined thereon, the buttons being touchable and movable inwardly to press the pressed portions of another spring arms.

13. The portable memory device as described in claim 11, wherein the movable metallic shell defines a pair of protrusions at a front end of the other sidewalls of the movable metallic shell, and wherein a pair of another recessed passageways defined in another opposite inner face of the case to allow the another spring arms and the protrusions being movable in the another passageways.

14. An electrical connector assembly, comprising:

an electronic device defining a mating port surrounded by an outer metal shell, the outer metal shell having an engagement portion defined therein;

a case defining a mating opening configured to mate with the mating port in a mating direction, the mating port and the outer metal shell being detachably inserted into the case through the mating opening; and a latching member defining a retaining portion engagable with the engagement portion and being movably associated with the case in the mating direction to thereby engage/disengage the assembly of the electronic device and the case;

wherein the case comprises a stopper portion engaged with the latching member to obstruct the latching member from moving forward when it is in an engaged position.

15. The electrical connector assembly as claimed in claim 14, wherein said latching member is received in the case.

16. The electrical connector assembly as claimed in claim 15, further comprising a metallic shell secured in the case, the latching member being defined in the metallic shell, the metallic shell enclosing the metal shell of the mating port and being movable with the inserting into and detaching from of the mating port relative to the case.

17. The electrical connector assembly as claimed in claim 16, further comprising a touchable disengaging member integrally with the case, and wherein the metallic shell in the case defines a pressed portion to be pressed inwardly by the disengaging member to a state in which the metallic shell is movable with the detaching movement of the mating port from the case.

18. An electrical connector assembly, comprising:

an electrical device defining a mating port surrounded by an outer metal shell, the outer metal shell having an engagement portion defined therein;

a case defining a mating opening configured to mate with the mating port in a mating direction, the mating port and the outer metal shell being detachably inserted into the case through the mating opening; and a latching member defining a retaining portion engagable with the engagement portion and being associated with the case and deflectable in a lateral direction perpendicular to the mating direction with a locked position and an unlocked position in said lateral direction to thereby engage/disengage the electrical with/from the case; wherein locking structures are formed on said latching member and said case to secure the latching member and said case in position when said latching member latches said electronic device;

wherein the case comprises a stopper portion engaged with the latching member to obstruct the latching member from moving forward when it is in an engaged position.

19. The electrical connector assembly as claimed in claim 18, wherein the deflection of said latching member in said lateral direction results from movement of said latching member relative to the case along said mating direction.

* * * * *